US008740555B2

(12) United States Patent
Ulma

(10) Patent No.: US 8,740,555 B2
(45) Date of Patent: Jun. 3, 2014

(54) STEAM TURBINE HAVING A COOLING APPARATUS

(75) Inventor: Andreas Ulma, Mülheim an der Ruhr (DE)

(73) Assignee: Siemens Aktiengesellschaft, München (DE)

( * ) Notice: Subject to any disclaimer, the term of this patent is extended or adjusted under 35 U.S.C. 154(b) by 847 days.

(21) Appl. No.: 12/988,346

(22) PCT Filed: Feb. 27, 2009

(86) PCT No.: PCT/EP2009/052382

§ 371 (c)(1),
(2), (4) Date: Dec. 29, 2010

(87) PCT Pub. No.: WO2009/130077

PCT Pub. Date: Oct. 29, 2009

(65) Prior Publication Data

US 2011/0116915 A1 May 19, 2011

(30) Foreign Application Priority Data

Apr. 21, 2008 (EP) ..... 08007704

(51) Int. Cl.
*F01D 25/12* (2006.01)

(52) U.S. Cl.
USPC ..... 415/175

(58) Field of Classification Search
USPC ..... 415/175, 108, 173, 220
See application file for complete search history.

(56) References Cited

U.S. PATENT DOCUMENTS

| | | | | |
|---|---|---|---|---|
| 4,498,301 | A * | 2/1985 | Tsubouchi | 60/657 |
| 4,896,499 | A | 1/1990 | Rice | |
| 6,149,074 | A | 11/2000 | Friedel et al. | |

FOREIGN PATENT DOCUMENTS

| | | | |
|---|---|---|---|
| DE | 1197096 | B | 7/1965 |
| DE | 1401036 | A1 | 1/1969 |
| DE | 2049430 | A1 | 10/1971 |
| DE | 3420389 | A1 | 12/1985 |
| DE | 69816190 | T2 | 5/2004 |
| JP | 59144256 | A | 8/1984 |
| JP | 60159310 | A * | 8/1985 |
| JP | 60195304 | A | 10/1985 |
| JP | 9060502 | A | 3/1997 |
| RU | 2210674 | C2 | 8/2003 |
| SU | 140808 | | 1/1961 |
| SU | 409434 | A1 | 1/1973 |
| SU | 409434 | A1 | 11/1973 |
| SU | 1129660 | A1 | 12/1984 |
| SU | 1126027 | A1 | 6/1985 |

* cited by examiner

*Primary Examiner* — Dwayne J White

(57) ABSTRACT

A turbomachine comprising a rotor, an inner housing, and an outer housing is proposed. The inner housing is arranged around the rotor and the outer housing is arranged around the inner housing, An encapsulation is arranged around the inner housing. An annular channel and holes into a chamber are provided between the encapsulation and the inner-housing outer surface, and steam flows out again via holes which are situated in the encapsulation.

6 Claims, 2 Drawing Sheets

STEAM TURBINE HAVING A COOLING APPARATUS

CROSS REFERENCE TO RELATED APPLICATIONS

This application is the US National Stage of International Application No. PCT/EP2009/052382, filed Feb. 27, 2009 and claims the benefit thereof. The International Application claims the benefits of European application No. 08007704.3 filed Apr. 21, 2008, both of the applications are incorporated by reference herein in their entirety.

FIELD OF THE INVENTION

The invention relates to a continuous flow machine, comprising a rotor, an inner housing which is arranged around the rotor, and an outer housing which is arranged around the inner housing, wherein a casing, which is closed to form a seal, is arranged around an area of the inner housing.

BACKGROUND OF THE INVENTION

In this case, the term a continuous flow machine means, in particular, a steam turbine. Steam turbines are subdivided into so-called high-pressure, medium-pressure or low-pressure turbine elements. At the moment, there is no standard subdivision of steam turbines into the abovementioned turbine elements. In general, a high-pressure turbine element has steam applied to it at a temperature of up to 620° C. and at a pressure of up to 350 bar. The steam flowing out of this high-pressure turbine element is heated in an intermediate superheater back to a temperature of up to 620° C. and then flows into the medium-pressure turbine element, with the steam then flowing out of the medium-pressure turbine element into the low-pressure turbine element. In general, steam turbines are designed with an inner housing based on the so-called two-shell or three-shell design.

By way of example, in a medium-pressure turbine element, the medium-pressure outlet steam flows around the inner housing. Depending on the circuit parameters, this medium-pressure outlet steam may be at comparatively low temperatures, thus leading to a comparatively high temperature difference between the inner housing inner wall and the inner housing outer wall. The so-called hot intermediate-superheated steam is applied to the inner housing inner wall, with the medium-pressure outlet steam flowing around the inner housing outer wall, as described above. Since the temperatures of the medium-pressure outlet steam and of the hot intermediate-superheated steam are comparatively different, this leads to different thermal loads on the inner housing. The high temperature differences lead to unacceptably high loads for example on the screws joining the elements and on the inner housing, which can lead to increased elastic and/or plastic housing deformation.

As a precaution against this housing deformation, it is now normal practice to encase the inner housing with steel sheets, in order to prevent medium-pressure outlet steam from flowing directly onto the inner housing outer surface. The casing is frequently referred to as a heat protection jacket or as a thermal shield, and is arranged around the entire inner housing. In order to maintain comparatively uniform environmental conditions, temperature distributions and uniform or low flow rates of the medium-pressure outlet steam on the inner housing surface, the heat protection jacket is designed such that gaps are created between the heat protection jacket and the inner housing. Furthermore, additional openings are arranged in the heat protection jacket, in order to allow the medium-pressure outlet steam to flow through the heat protection jacket.

This has the disadvantage that the actual conditions within the heat protection jacket are virtually impossible to change. This means that the actual conditions cannot be matched to the requirement for the inner housing. In this case, it would be desirable for it to be possible to adjust the temperature within the heat protection jacket. This means that it would be advantageous to deliberately increase or reduce the temperature within the jacket.

SUMMARY OF THE INVENTION

The object of the invention is to improve a continuous flow machine such that it is possible to avoid unacceptable temperature differences in the inner housing.

The object is achieved by a continuous flow machine, comprising a rotor, an inner housing which is arranged around the rotor, and an outer housing which is arranged around the inner housing, wherein a casing, which is closed to form a seal, is arranged around an area of the inner housing, wherein the casing has an inlet for steam to flow in and an outlet for steam located in the casing to flow out, and the inlet comprises an annular channel.

The invention accordingly proposes a way to allow steam to flow deliberately into the area of the casing. The temperature in the area of the casing can be varied by the mass flow of the steam into this area. This means that the temperature on the inner housing outer surface can be varied for different operating conditions, in which different temperatures may occur within the inner housing.

It is therefore possible to vary the operating conditions outside the inner housing, in which case, in principle, this means the area which is adjacent to the inner housing outer surface. A further advantage of the invention is that the temperatures on the inner housing outer surface can be adjusted during a starting process or during a shutdown process, thus making it possible to set a temperature gradient in the inner housing which leads to unacceptably high loads on screws joining the elements and the inner housing being avoided.

The annular channel is in this case arranged around the casing. A continuous annular channel is preferably provided, that is to say that steam is supplied via an outer inlet line to the annular channel, and this steam completely surrounds the casing in the annular channel, ensuring that the steam flows via holes into the area within the casing. In alternative embodiments, it is possible to subdivide the annular channel into two ring elements, wherein one annular channel element can be associated with a lower inner housing lower part, and the second annular channel element can be associated with the inner housing upper part. However, in this case, separate inlet lines must in each case be made available for each annular channel element. In order to maintain a flexible supply of steam, it is, of course, possible to pass a plurality of inlet channels to the annular channel.

Advantageous developments are specified in the dependent claims.

For example, it is advantageous for the casing to be manufactured from sheet metal. This is a particularly advantageous option, which can be produced quickly, in order to achieve the aims of the invention. In particular, sheet steel can be used here. The temperature conditions in the continuous flow machine must, of course, be such that metal sheets or steel sheets can be used. In particular, care must be taken to ensure that the temperatures of the medium-pressure outlet steam do not lead to damage to the metal sheets or steel sheets.

In a further advantageous development, the casing forms a seal with respect to the inner housing. This has the advantage that no steam flowing into the casing flows out again in an uncontrolled manner. It is therefore possible to set conditions within the casing better from the outside. A first possible way to set the conditions from the outside is simply to adjust the mass flow of the steam flowing into the casing via this or by means of valves. A further possible way to vary the conditions is to vary the temperature of the steam.

The inlet flow of the steam into the internal area of the casing is achieved by holes, in particular radial holes. A deliberate, uniform inlet flow into the area of the casing can be achieved by the arrangement, size and number of the holes.

In a further advantageous development, the casing is arranged in the area of the inlet-flow area. Particularly in medium-pressure turbine elements, the inlet-flow area is the area in which the greatest thermal loads occur. This means that the inner housing is unacceptably thermally loaded in particular in this area. The outlet steam area of the inner housing is comparatively lightly thermally loaded in comparison to this. There is therefore no need to completely encase the inner housing. In fact, it is expedient to encase only the areas which are particularly highly thermally loaded and where an unacceptable temperature gradient should be avoided between the inner housing inner surface and the inner housing outer surface. This area is actually the inlet-flow area, for which reason this advantageous development proposes that this inlet-flow area actually be encased.

In a further advantageous development, the outlet has a plurality of radial holes in the casing. It is therefore possible to easily carry steam emerging from the casing away, which steam, of course, has different thermodynamic variables such as temperature and pressure than the steam flowing into the casing. A specific and uniform outlet flow from the casing can be achieved by the arrangement, size and number of the radial holes.

In a further advantageous development, a heat-moving seal can be arranged between the casing and the inner housing. In general, steam is applied to steam turbines continuously, leading to a uniform temperature distribution within the steam turbine. However, operating conditions exist, for example when the steam turbine is being started up and shut down, in which different thermal expansions of the various components in the steam turbine are possible. In particular, the casing, which is manufactured from steel sheets, may have a different thermal expansion to that of the inner housing, leading to deformation of the casing or to an undesirable gap between the casing and the inner housing. This undesirable effect can be avoided by a heat-moving seal.

BRIEF DESCRIPTION OF THE DRAWINGS

The invention will be described in more detail with reference to FIGS. 1 and 2, in which.

DETAILED DESCRIPTION OF THE INVENTION

Figure 1:
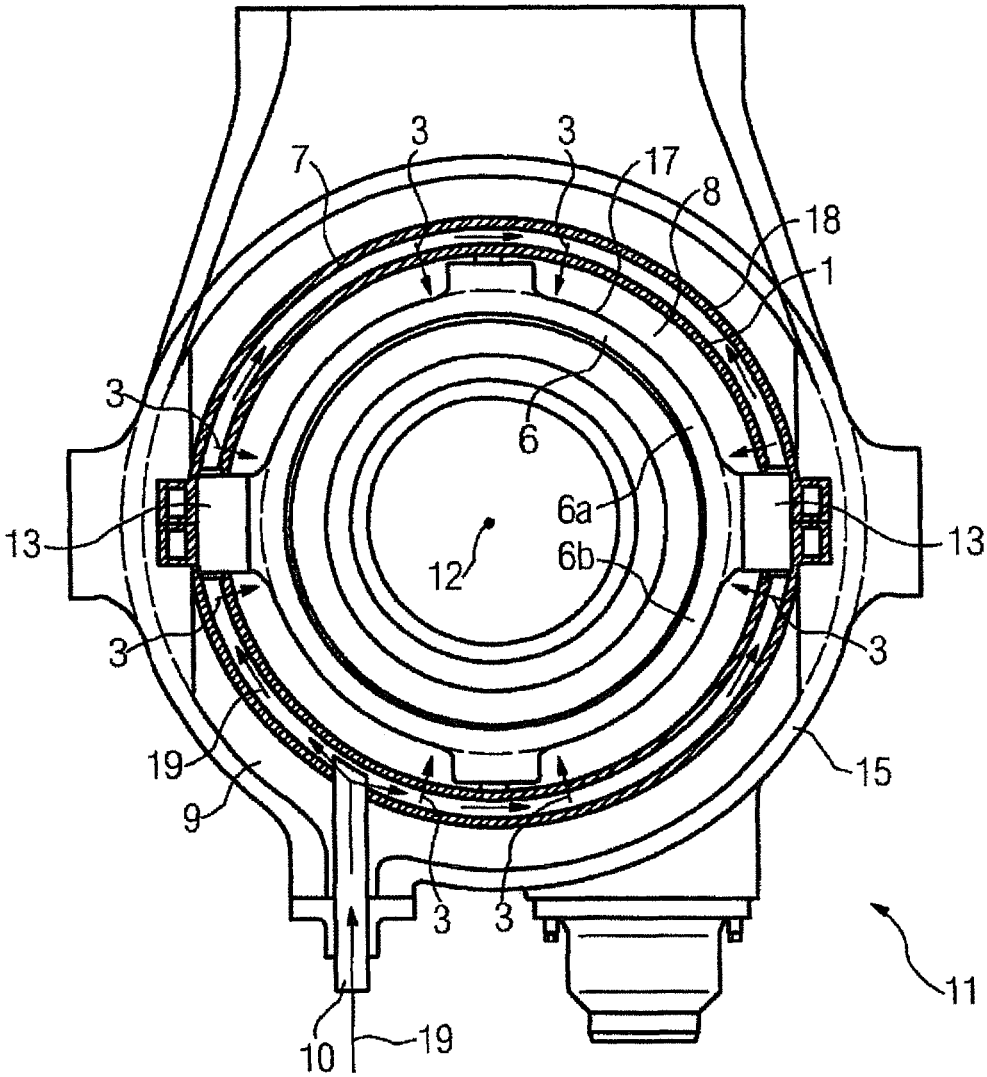
FIG. 1 shows a cross-sectional view in the radial direction of a steam turbine.

FIG. 1 shows a cross-sectional view in the axial direction of a medium-pressure turbine element 11. The medium-pressure turbine element 11 has an inner housing 6 which is essentially rotationally symmetrical about the rotation axis 12, with the inner housing 6 consisting of an inner housing upper part 6*a* and an inner housing lower part 6*b*. The inner housing upper part 6*a* is connected to the inner housing lower part 6*b* via a flange 13 and via screws, which are not illustrated in any more detail. For the sake of clarity, the further components, such as a rotor 14, are not illustrated in any more detail.

An outer housing 15 is arranged around the inner housing 6. A casing 1 is arranged around the inner housing 6, for thermal shielding. The casing 1 may be formed from steel sheets and may be arranged via heat-moving seals 16 on the inner housing 6. The medium-pressure outlet steam is located in the outlet steam area 9 during operation, and is at a considerably lower temperature and a considerably lower pressure than the fresh steam flowing into the medium-pressure steam turbine 11. This medium-pressure outlet steam is prevented from acting on an inner housing outer surface 17 by means of the casing 1. The casing 1 furthermore has an annular channel 18, which forms an annular area 2, which is connected for flow purposes to an inlet channel 10. As illustrated by arrows 19, steam flows via the inlet channel 10 into the annular area 2 and is distributed circumferentially over the inner housing 6. The steam flows via radial holes 3, which are located in the casing 1, into an area 5 which is formed between the casing 1 and the inner housing outer surface 17.

In principle, the steam which is supplied via the inlet 10 can also be passed directly into the area 5. The annular area 2 is provided for better distribution over the circumference.

FIG. 1 does not show in any more detail how the steam flows out of the area 5.

Figure 2:
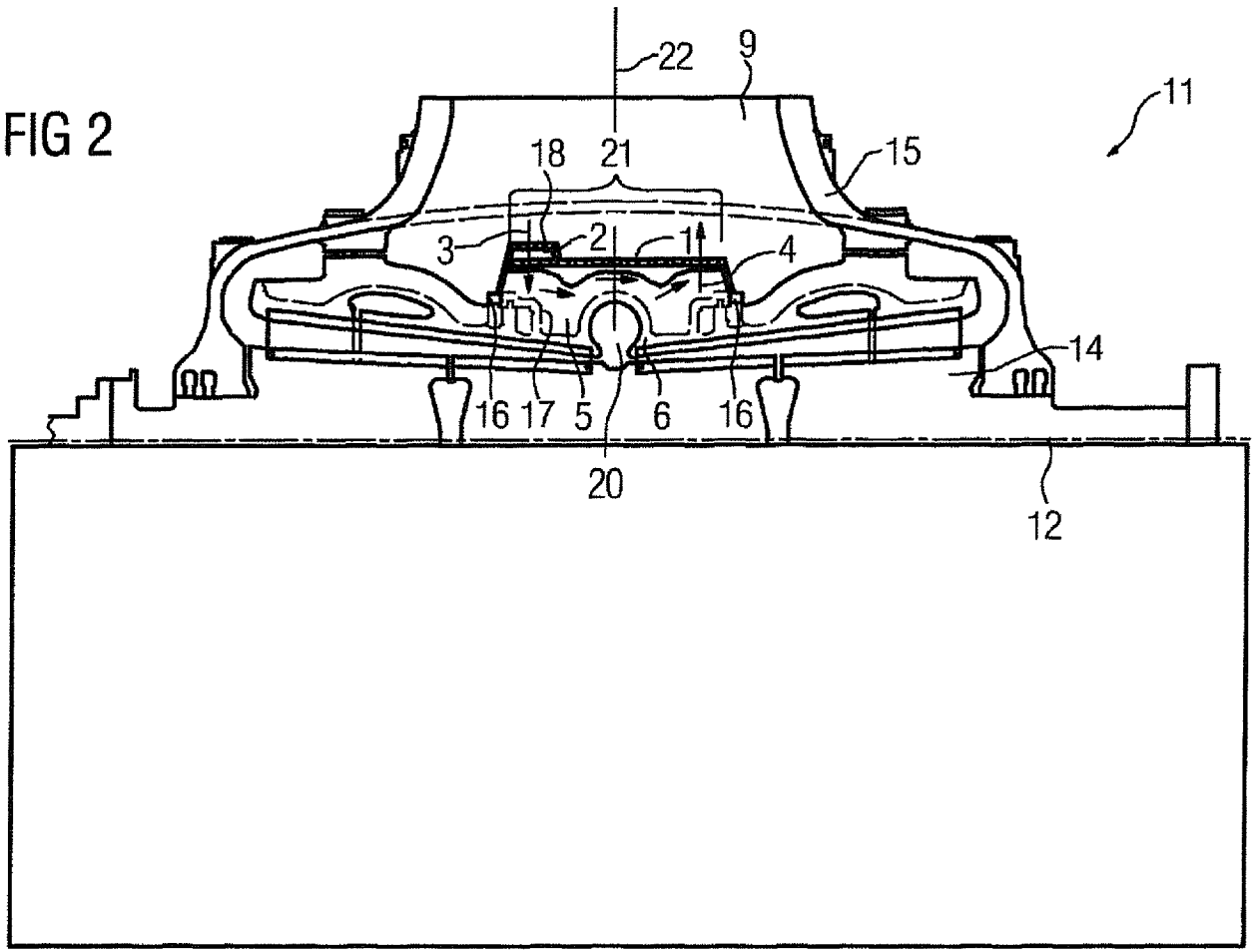
FIG. 2 shows a cross-sectional view of a medium-pressure turbine element.

FIG. 2 shows a cross-sectional view of the medium-pressure turbine element 11. The most highly thermally loaded area of this medium-pressure turbine element 1 is the area around the inlet-flow area 20. As can be seen from FIG. 2, the casing 1 is not arranged over the entire inner housing, but around the inlet-flow area 20, since this is the most highly thermally loaded. The annular channel 18 is likewise not formed over the entire axial length of the casing 1, but only over a shorter axial extent. The annular area 18 in the exemplary embodiment shown in FIG. 2 is arranged to the left of the line 22 at the edge of the casing 1, and extends over approximately one quarter of the axial length 21 of the casing 1. The steam which enters via the holes 3, which are preferably formed radially, will emerge from the area 5 via holes 4, which are likewise preferably formed radially. The steam emerging from the holes 4 has different thermodynamic variables, for example temperature and pressure, than the steam flowing into the hole 3. The arrangement of the size and number of the holes 3, 4 makes it possible to achieve a specific, uniform inlet and outlet flow. The steam which flows into the annular area 2 via the inlet channel 10 may be taken, for example, from so-called cold intermediate superheating. The casing 1 can be designed such that the pressures in the inlet 10, in the annular area 2 and in the area 5 are only slightly greater than in the outlet steam area 9, which means that the casing 1 does not need to be designed to withstand pressure. Steam flowing into the annular area 2, and, finally, into the area 5 leads to an influence on the temperature and the flow conditions on the inner housing surface 17, which can be influenced via the temperature and the mass flow of the steam flowing into the inlet channel 10. This can be done by a fixedly chosen setting or by closed-loop control. Furthermore, the temperature distribution can be made uniform. The steam flowing into the area 5 improves the deformation behavior of the inner housing 6, thus resulting in a reduction in the amount of radial clearance required. Loads on the housing and on the screws are thus reduced, likewise minimizing plastic deformation resulting from material creepage.

The invention claimed is:

1. A continuous flow machine, comprising:

a rotor;

an inner housing that is arranged around the rotor;

an outer housing that is arranged around the inner housing;

a casing that is arranged around an area of the inner housing;

an inlet that is arranged in the casing for steam to flow in, wherein the inlet comprises an annular channel; and an outlet that is arranged in the casing for steam located in the casing to flow out, wherein a free-expanding seal is arranged between the casing and the inner housing.

2. The continuous flow machine as claimed in claim 1, wherein the casing is manufactured from sheet metal.

3. The continuous flow machine as claimed in claim 1, wherein the casing is closed to form a seal with respect to the inner housing.

4. The continuous flow machine as claimed in claim 1, wherein the casing is arranged in an inlet-flow area.

5. The continuous flow machine as claimed in claim 1, wherein a plurality of inlets are distributed around a circumference in the casing.

6. The continuous flow machine as claimed in claim 1, wherein the outlet comprises a plurality of radial holes in the casing.

* * * * *